United States Patent [19]

Vigede

[11] Patent Number: 4,635,367

[45] Date of Patent: Jan. 13, 1987

[54] METHOD FOR TAKING BODY MEASUREMENT AND APPARATUS FOR PERFORMING THE METHOD AS WELL AS A SYSTEM FOR TAKING BODY MEASUREMENT AND PRODUCING GARMENTS

[75] Inventor: Thure Vigede, Huddinge, Sweden

[73] Assignee: Proca Consulting AB, Huddinge, Sweden

[21] Appl. No.: 579,889

[22] PCT Filed: Jun. 3, 1983

[86] PCT No.: PCT/SE83/00227

§ 371 Date: Feb. 3, 1984

§ 102(e) Date: Feb. 3, 1984

[87] PCT Pub. No.: WO83/04366

PCT Pub. Date: Dec. 22, 1983

[30] Foreign Application Priority Data

Jun. 8, 1982 [SE] Sweden ..... 8203542

[51] Int. Cl.[4] ..... A41H 1/02

[52] U.S. Cl. ..... 33/15; 33/512

[58] Field of Search ..... 33/15, 11, 17 R, 13, 33/14, 512

[56] References Cited

U.S. PATENT DOCUMENTS

| | | | |
|---|---|---|---|
| 2,052,099 | 8/1936 | Lytton | 33/8 |
| 2,374,654 | 5/1945 | Cooke | 33/15 |
| 3,753,293 | 8/1973 | Branda et al. | 33/8 |
| 3,979,831 | 9/1976 | Lutz | 33/11 |
| 4,211,011 | 7/1980 | Jacobson | 33/15 |

FOREIGN PATENT DOCUMENTS

| | | |
|---|---|---|
| 1370762 | 7/1964 | France . |
| 193457 | 4/1964 | Sweden . |
| 1463804 | 2/1977 | United Kingdom . |
| 695653 | 11/1979 | U.S.S.R. . |

*Primary Examiner*—Richard R. Stearns

*Attorney, Agent, or Firm*—Burns, Doane, Swecker & Mathis

[57] ABSTRACT

Body measurements are taken by attaching a number of measuring tapes to a person. Each measuring tape is provided with at least one electrically detectable measuring range within which at least one individual measuring point is detected by means of an electrical connector positioned at the measuring points, for converting the detected measuring point to an electric signal. The signal from each measuring point is supplied to a central memory and calculating unit in which the body measurements of the person are converted into a pattern for the manufacture of the garment. Instead of employing an electrically detectable measuring range, an optically detectable range can be employed which is detected by an optical scanner.

16 Claims, 23 Drawing Figures

Fig. 5
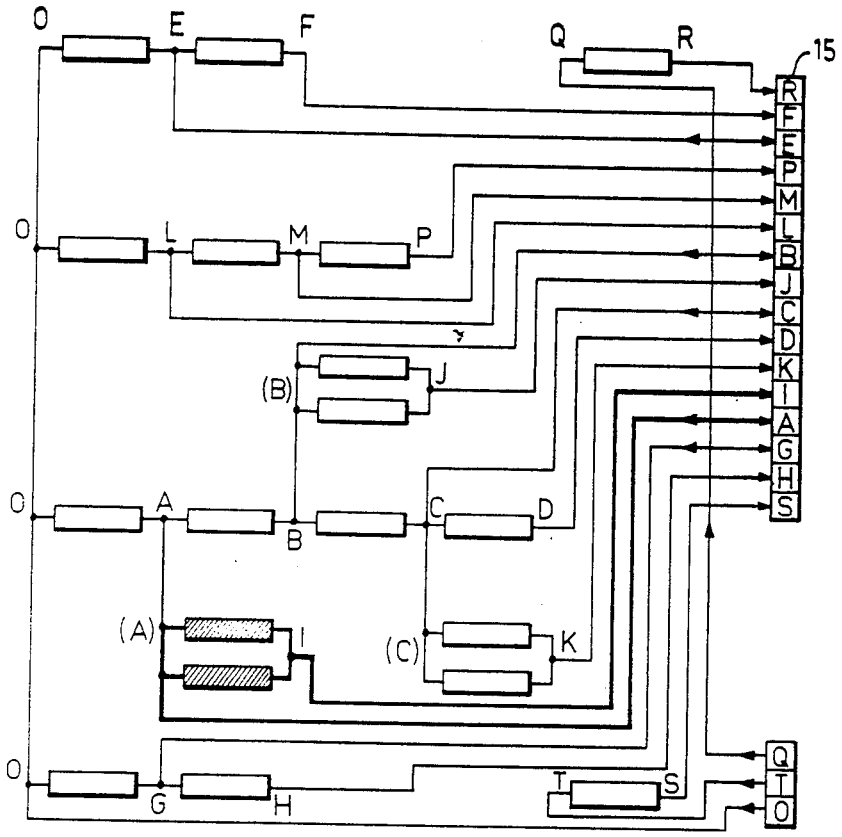
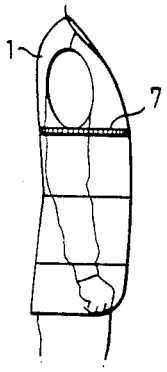
FIG. 5A

Fig. 6
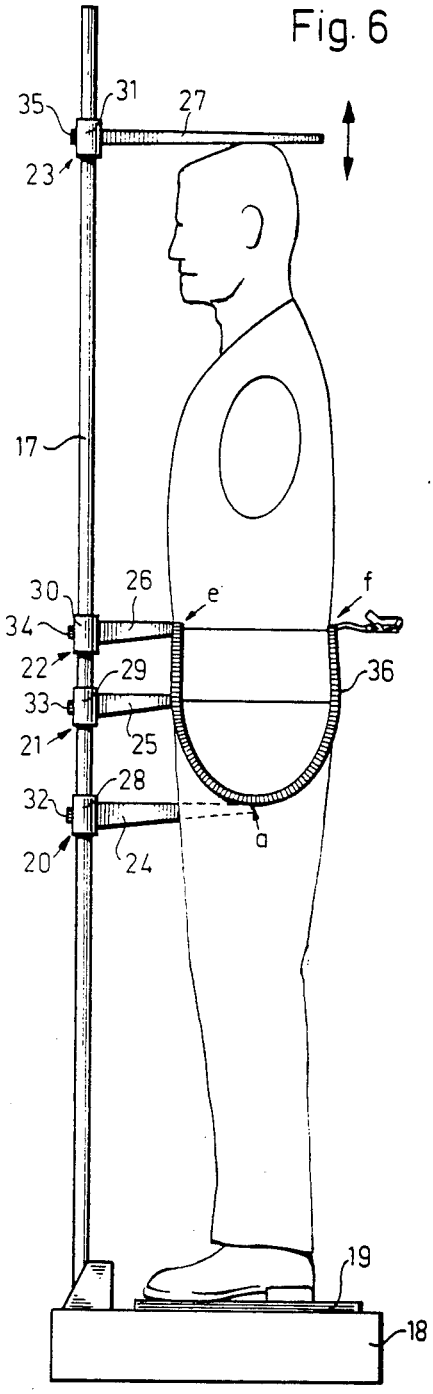
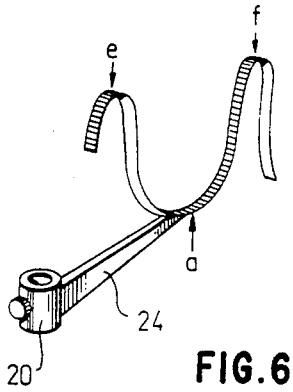
FIG. 6A

Fig. 7
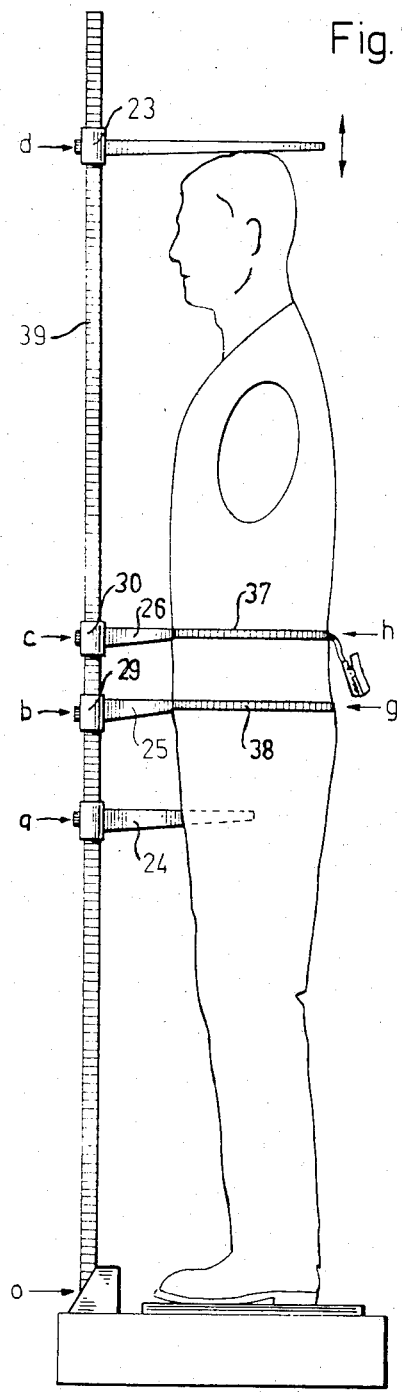
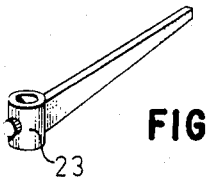
FIG. 7A
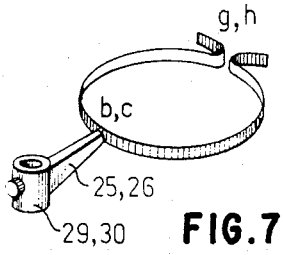
FIG. 7B

Fig. 8
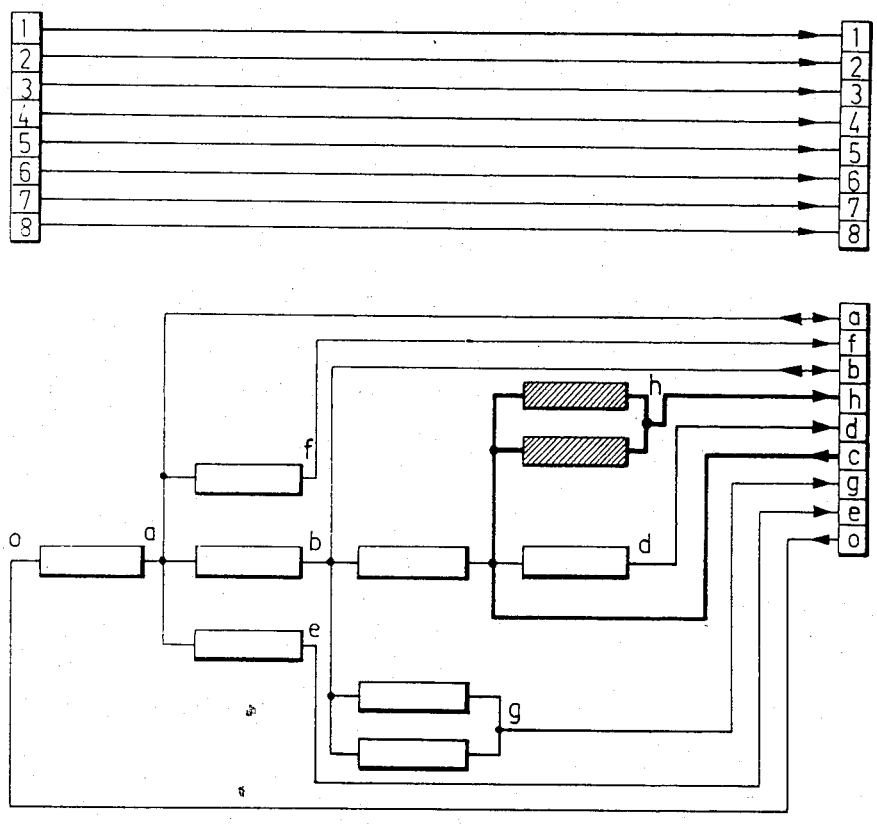
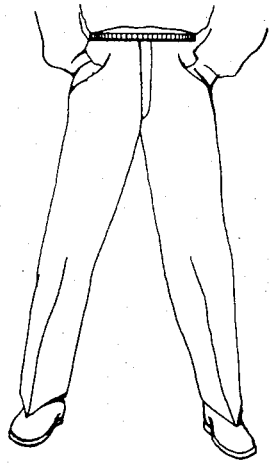
FIG. 8A

METHOD FOR TAKING BODY MEASUREMENT AND APPARATUS FOR PERFORMING THE METHOD AS WELL AS A SYSTEM FOR TAKING BODY MEASUREMENT AND PRODUCING GARMENTS

BACKGROUND AND OBJECTS OF THE INVENTION

The present invention relates to a method for taking body measurement and an apparatus for performing the method. The invention also relates to a system for taking such measurements and producing garments, thereby utilizing an apparatus for body measurement and comprising a measuring garment on wich adjustably attachable measuring tapes are intended to indicate the body measurements of a person being measured.

Apparatus of the abovementioned kind are known in the prior art in a variety of embodiments, for example from SE-PS No. 193 457, GP-PS No. 1 463 804, FR-PS No. 1 370 762, SU-PS No. 695 653 and U.S. Pat. Nos. 2,052,099 and 3,753,293. Most of these already known apparatuses include a rigid stand or a device on which measuring rods or other indicating means are attached, the setting of such means against a person standing in front of the device being indicated either purely visibly, or electrically. Only the abovementioned Russian and French patents disclose a measuring garment to which are attached measuring tapes for indicating individual deviations from the garment.

All the measuring apparatuses cited above are complicated and difficult to handle, however, resulting in uncertain values for the measurements taken. Furthermore, all the measurements necessary for preparing a pattern of the garment are not obtained and they must be supplemented by manual measurements to obtain all the information required for preparing such a pattern. Such measuring apparatus is thus not suitable for incorporation in a computer-based, electronic measuring system, where all the measurement and personal details are automatically obtained at a measurement station, from where they may be transmitted directly to the clothing manufacturer.

The object of the present invention is to make possible a method for taking body measurement with which is obtained all the measurement information necessary for preparing a pattern on which the production of the corresponding garment is based.

A further object of the invention is to provide an apparatus for performing the method, which apparatus is suitable for integrating into a computer-based system for taking measurements and producing garments.

A still further object of the invention is to provide a system for taking body measurements and producing garments by utilizing an apparatus for taking body measurements according to the invention in order to accomplish a highly rational handling in the shop line as well as the production line.

These objects are realized in a method, an apparatus and a system as defined in the attached claims.

The system for taking measurements and producing garments in accordance with the invention is essentially characterized by the measuring apparatus being placed in a plurality of locally situated shops, and adapted for communication with a computer in a central manufacturing plant. The individual measurements and personal information gathered in the shop being transmittable to the computer for storage in a register unit, which also stores information on the standard sizes in the garment range. The central computer also includes a unit for comparing measurements with standard sizes, and for transmitting the result thereof to a display unit in the shop. After receiving a customer's order the central computer is intended for transferring the measurements taken and other pertinent information to a pattern unit where information on the ordered pattern is caused to actuate a control computer for programming and controlling manufacturing units.

A system for taking measurements according to the invention, in which a measuring apparatus is incorporated as an integrated part, enables highly rationalized handling, both on the retail and manufacturing sides. Clothes can be ordered with the aid of a catalogue, or in a shop where the customer only needs to see the different models in the article range, and samples of the different fabrics in stock, which naturally means that the clothing shops can reduce their stocks considerably. When sufficient orders have been received at the factory, production is started and automatically supervised by the computerized system. The inventive system thus enables high quality, and reduces the costs for the shops as well as for the manufacturing plants, which in turn enables more advantageous price competition with the imports from countries where wages and manufacturing costs are low. Using a system in accordance with the invention, the textile industry can take an important technological step forward, affording quite different possibilities of structural rationalization and efficiency engineering than what may be realized in the clothing industry as it is at present. Competitive prices in combination with individually adaptable clothing manufacture would result in substantially increased manufacture and order inut, which in turn would mean more permanent employment for clothing industry employees, with the possibility of progressive wage advancement.

The articles of clothing embraced by the invention are primarily so-called heavy garments such as suits, sports coats, trousers, overcoats, coats, custumes and uniforms of all kinds. As a secondary possibility, light goods could also be included, for example frocks, blouses, shirts, etc. By using a system in accordance with the invention heavy as well as light garments could be produced at prices substantially below those prevailing at present.

THE DRAWINGS

An embodiment of an inventive measuring apparatus, selected as an example, and a system incorporating it will now be described in detail with reference to the appended drawings, on which FIGS. 1A and 1B are front and back views, respectively, of a measuring garment according to the invention in the form of a jacket, FIGS. 2A and 2B are views similar to FIGS. 1A and 1B, respectively, where the measuring tapes drawn in form a separate electrical system, FIGS. 3A and 3B are views similar to FIGS. 1A and 1B, respectively, where the measuring tapes drawn in form a second electrical system, FIGS. 4A and 4B are views similar to FIGS. 1A and 1B, respectively, where the tapes drawn in form a third electrical system, FIG. 5 illustrates a circuit diagram for the jacket of FIGS. 1–4, as well as an example of the circuit paths activated to measure the chest dimension as indicated in FIG. 5A, FIG. 6 illustrates a separate stand, in accordance with the invention, with contact members which are adjustable in height, and also a measuring tape on a trousers portion, forming a separate electrical system, FIG. 6A is a perspective view of the measuring tape depicted in FIG. 6, FIG. 7 shows the stand of FIG. 6, and the measuring tapes which, together with a measurement reference on the stand, form a second separate electrical circuit, FIG. 7A is a perspective view of a measuring bar depicted in FIG. 7, FIG. 7B is a perspective view of a waist measuring tape depicted in FIG. 7, FIG. 8 illustrates a wiring diagram for the trousers part depicted in FIGS. 6 and 7, and an example of the circuit paths activated to measure the waist dimension as indicated in FIG. 8A, FIG. 9 shows an alternative embodiment of the measuring tape and the electrical system according to the invention, where the measurement ranges are located on an external analogue measuring reference, FIG. 10 illustrates a further alternative embodiment of a measuring tape and the electrical measuring system connected thereto where the measuring points are connected to an external digital measuring reference, FIG. 11 shows a front view of an alternative measuring garment according to the invention where the measuring tapes are provided with an optical code for readout by means of an optical reading pen, FIG. 11A is an enlarged fragmentary view of a stiffening frame depicted in FIG. 11, FIG. 12 illustrates the measuring garment according to FIG. 11 from behind, FIG. 13 is a block diagram of a system for taking measurements and producing garments in accordance with the invention.

DETAILED DESCRIPTION OF PREFERRED EMBODIMENTS OF THE INVENTION

Figure 1B:
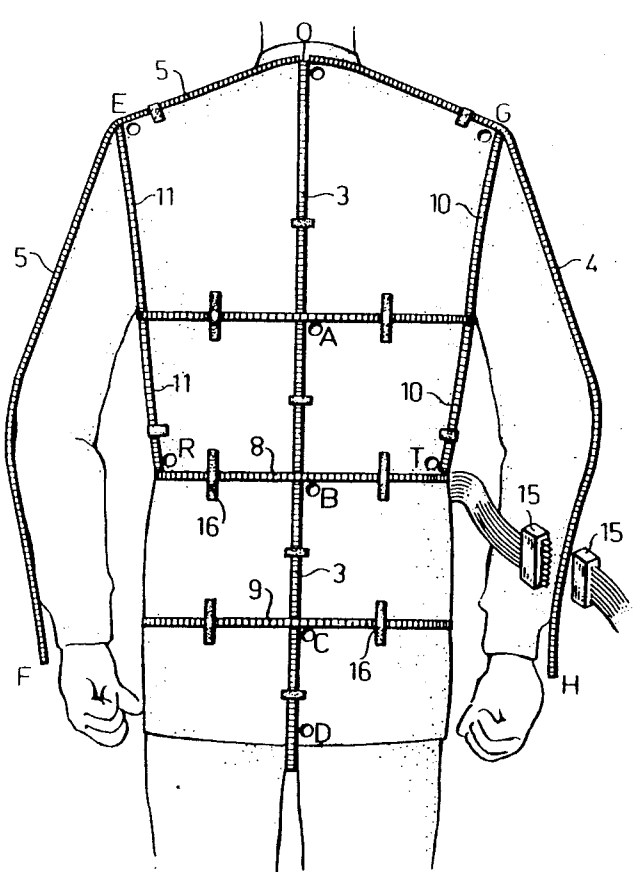
Figure 1A:
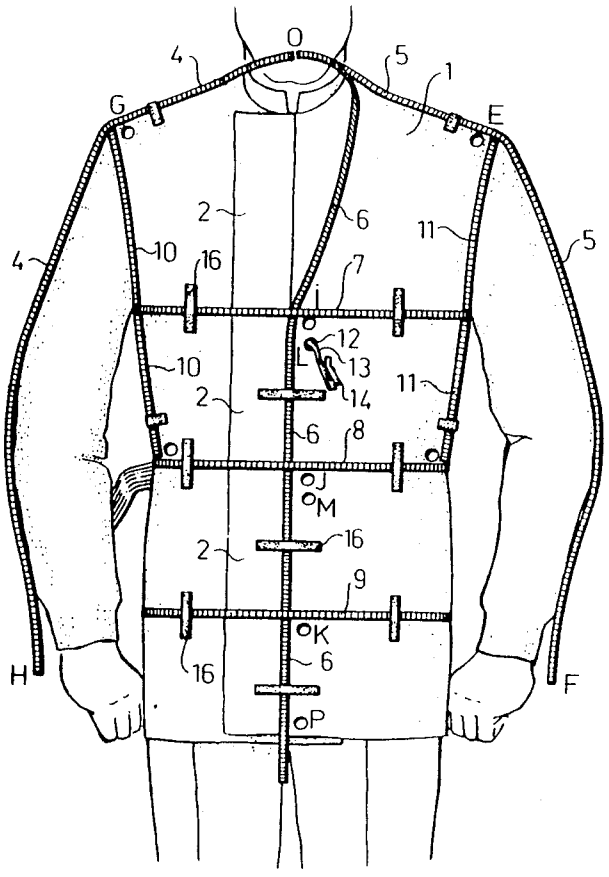

The measuring apparatus of FIGS. 1A and 1B includes a jacket 1, suitably comprising two layers of elastic, textile or synthetic material, and which is provided with a fastener arrangement 2, suitably in the form of a tab fastening against the underlying part, e.g. by means of Velcro® tape or the like. The jacket 1 is thus individually adapted to the body measurements of a person who can put it on so that it fits well. The jacket 1 constitutes a carrier for a system of electrically conductive measuring tapes, the number and location of which on the garment are determined by how the desired garment is to be made up. The jacket shown in FIGS. 1A, 1B has nine measuring tapes, placed in the following way:

a first tape 3 goes from the first curvical vertibra or atlas vertically towards the floor at the back of the jacket. A second tape 4 goes from the atlas, over the outer shoulder line extremity and to the right-hand wrist. A third tape 5 goes from the atlas, over the outer shoulder line extremity and to the wrist on the left. A fourth tape 6 goes from the atlas, over the inner shoulder line termination and to the front vertical line on a level with the lower edge of the armhole, and then vertically downwards. A fifth tape 7 goes round the chest on a level with the armhole lower edge. A sixth tape 8 goes round the waist. A seventh tape 9 is located so as to measure seat-width. An eighth tape 10 goes from waist height on the right at the front, up to the outer shoulder line extremity and back again to waist height on the right at the back. A ninth tape 11 goes from waist height on the left at the front, up to the outer shoulder line extremity and back again to waist height on the left at the back. The tapes pass over a plurality of measuring points on the jacket, and adjacent these points there are eyeletted holes 12 in the outer fabric. Electric leads 13 are taken through the holes and their ends attached to alligator clips 14. In FIG. 1A only one hole has been shown with a lead passing through it, and a clip on the end of the lead, although all the holes are provided with these contact means. The electrical leads 13 are taken between the fabric layers of the jacket, and are collected at waist height on the right (seen from the back) for taking out through one side seam of the outer fabric, where they are connected to a connection means 15, in turn intended for connection to an unillustrated computer. The tapes are removably fastened to the jacket by means of tabs 16, suitably consisting of strips of Velcro® tape, are arranged for keeping the tape in place at the jacket measuring points when pressed together. In the Figure, these points have been denoted A to T (N excepted). In all these cases there is thus a clip connected to a lead and intended for attachment to the adjacent tape at the point constituting the associated measuring point on the jacket.

Figure 2B:
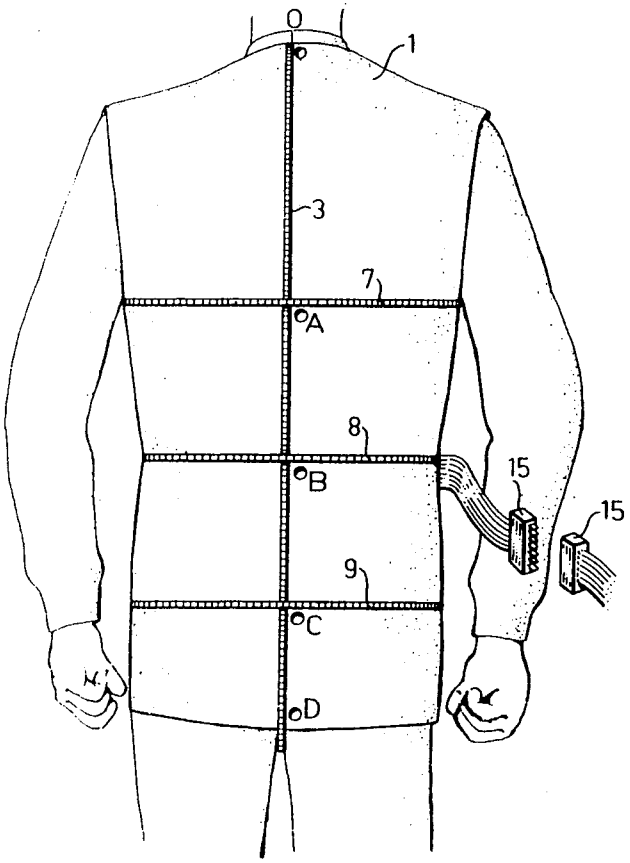
Figure 2A:
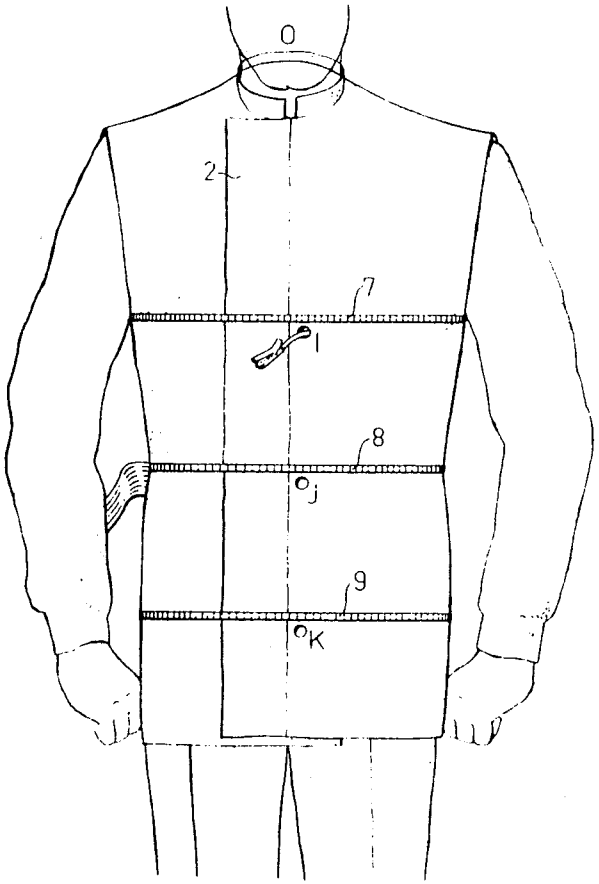

On FIGS. 2A, 2B the jacket of FIGS. 1A, 1B is shown with the tapes drawn in, which form a first system of measuring points on the jacket. These points are I, J, K on the front and O, A, B, C, D on the back. The vertical tape O–D from the K atlas towards the floor is thus electrically connected to the horizontal tapes going round the chest, waist and seat at the points A, B and C. As will be seen from the wiring diagram in FIG. 5, measurement of the chest, waist and seat signifies measurement of the tape impedance in both branch lines between the points A and I. Since the measuring device (not shown) applied to the connection means 15 senses the resultant impedance between these two points, and the impedance in both branch lines are of equal magnitude, the measuring device can readily convert the measured value to one corresponding in this case to the chest measurement. As will be easily understood, the impedance measured between the points A and I is a quarter of that for the actual peripheral length. In a similar way, the waist and seat measurements are taken between points J and B and K and C, respectively. The measurements between points O–A, A–B, B–C and C–D are obtained as a direct function of the tape impedance between these points, which will be clearly seen from the wiring diagram in FIG. 5.

Figure 3B:
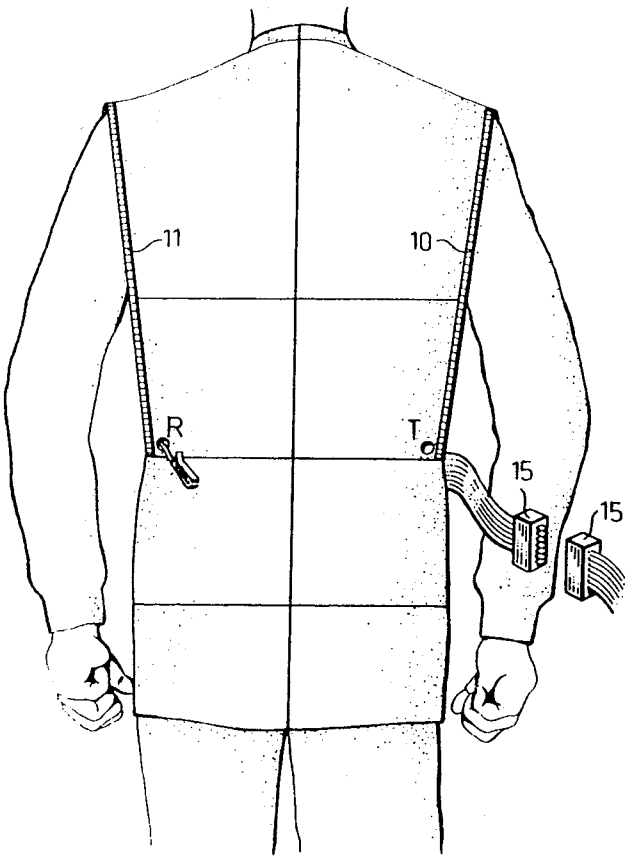
Figure 3A:
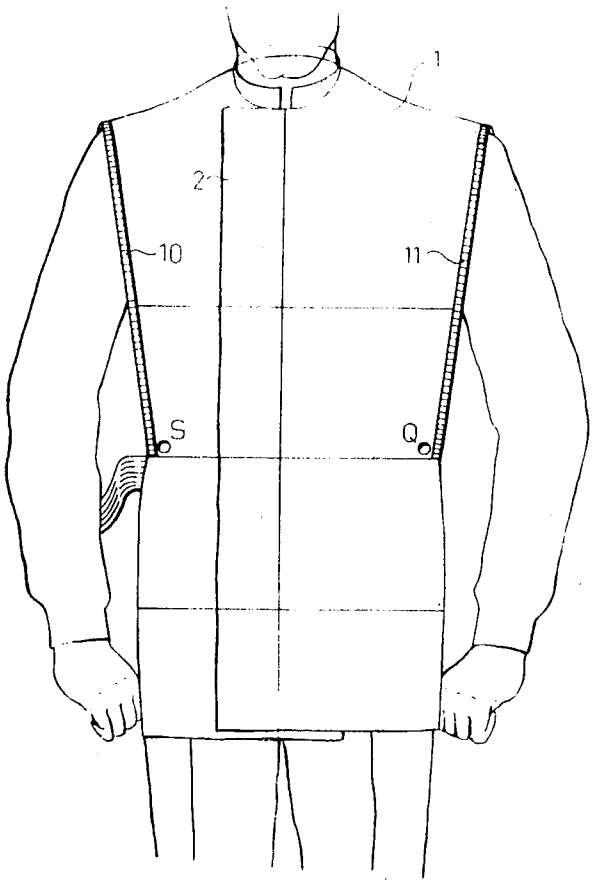
Figure 4B:
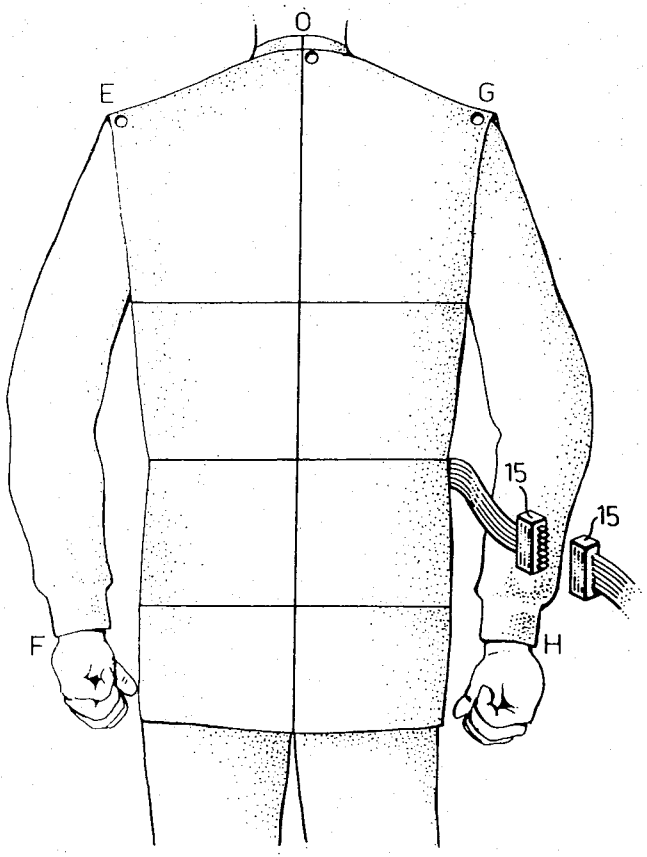
Figure 4A:
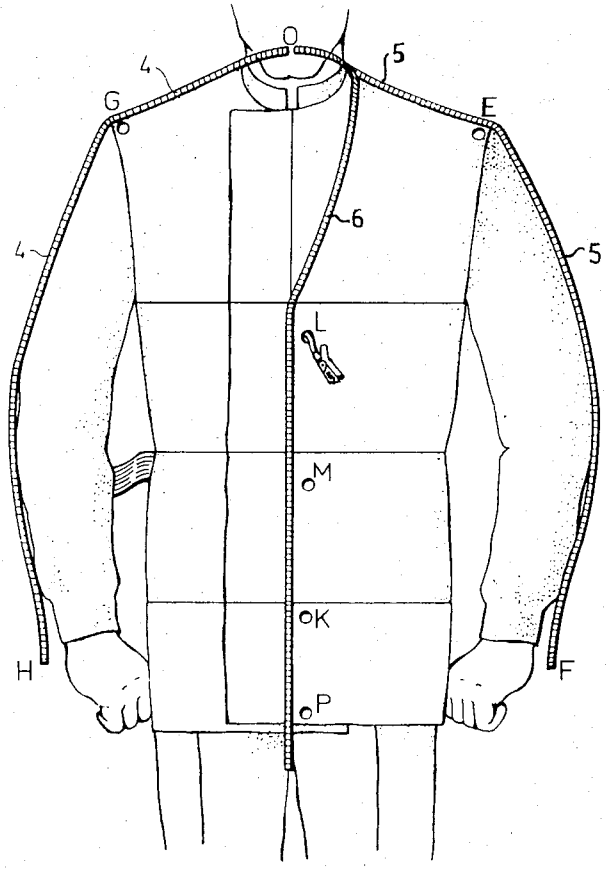

In FIGS. 3A, 3B there will be seen the measuring points on the jacket, forming a second system of points not electrically coupled to the points of FIGS. 2A and 4A. By connecting the alligator clips to the measuring points S and T and Q and R, the waist height on the right and left, respectively, of the jacket are measured and are thus given the total values of the impedance for the corresponding lengths of the measuring tapes 10 and 11, corresponding to the impedance values S–T and Q–R, respectively, as apparent from the wiring diagram in FIG. 5.

The measuring points on the jacket, forming a third electrical system, will be seen from FIGS. 4A, 4B, the measuring tapes used being electrically insulated from the crossing tapes round the chest, waist and seat. Application of the alligator clips to the points shown in the Figure gives the impedance values measured between them directly, and as will be seen from the wiring diagram in FIG. 5, the respective impedance is a direct representation of the length between the points. Thus, the distance from the atlas to the right-hand shoulder line extremity corresponds to the impedance O–G, and the left-hand one to the impedance O–E. The lengths G–H, E–F, O–L, L–M and M–P similarly correspond to the impedances between the respective points.

In FIGS. 6 and 7 a measuring garment is shown, in this case consisting of the customer's own trousers, to which the measuring tapes have been attached directly, either by pins or by the alligator clips, for taking the lower body measurements, e.g. those for the trousers. Of course, the measuring jacket described above is not essential to the invention, and the customer's own vest or jacket may be used. The connection means include a stand 17 fixed to a base plate 18 which can advantageously also support a person scales 19. The stand 17 is provided with contact members, displaceable in height, the lower ones 20–22 being provided with contact arms 24–26. These arms are intended for bringing into engagement with the measuring tapes at the points on the trousers between which the impedances of the tapes are to be measured, for obtaining the actual lengths between the points. The uppermost contact member 23 is provided with a bar or boom 27 for measuring the height of a person standing on the scales 19. The contact arms 24–26 and bar 27 are attached to gliding collars 28–31 which may be clamped to the stand post 17 by means of clamping screws 32–35. In the Figure there is illustrated an electrically conductive measuring tape 36, arranged to go from a measuring point e at the front of the trousers at waist height, down round the crotch and up to a measuring point f at the back, similarly at waist height. A third measuring point a is arranged for measuring the front and back crotch lengths. The front point e and the point a in crotch are connected to the current source via the contact arms 24 and 26, while the back point f is connected in the same way as with the measuring jacket, i.e. with a clip, in turn connected to the current source via a lead. As for the jacket, the impedance between the points a,e and a,f will correspond to the lengths on the measuring tape between these points.

In FIG. 7, the measuring tapes and references are illustrated which form a separate electrical system from the measuring circuit of FIG. 6, and the intention here is to measure the height of the points above a given reference level, as well as the waist and seat widths, i.e. the peripheral measurements at waist and seat, at the respective heights thereof. Measuring the waist is exemplified in FIGS. 8, 8A a measuring tape 37 being utilized between the points c and h, both parallel-coupled impedances between these points readily being convertible to the waist width. The seat width is obtained in the same way, using a measuring tape 38 and measuring the impedances between the points b and g. Since the stand is similarly formed as a measuring reference 39, the electrical properties of which are proportional to each unit length of the reference, the levels of the points a,b,c and d above the reference level o are easily obtained. The impedances o–c, o–b and o–a thus correspond to the height from the sole of the foot to the waist, to the seat and to the crotch, respectively. The total height o–d is also readily obtained by measuring the corresponding impedance. As will be seen from the wiring diagram in FIG. 8, the scales has also been connected to the measuring unit, to give a complete picture of the build of the person in question.

The measured electrical impedance of the tapes is thus considered here to comprise a resistance, an inductance or capacitance, or a combination thereof. A suitable embodiment may also comprise a semiconductor material.

Figure 9:
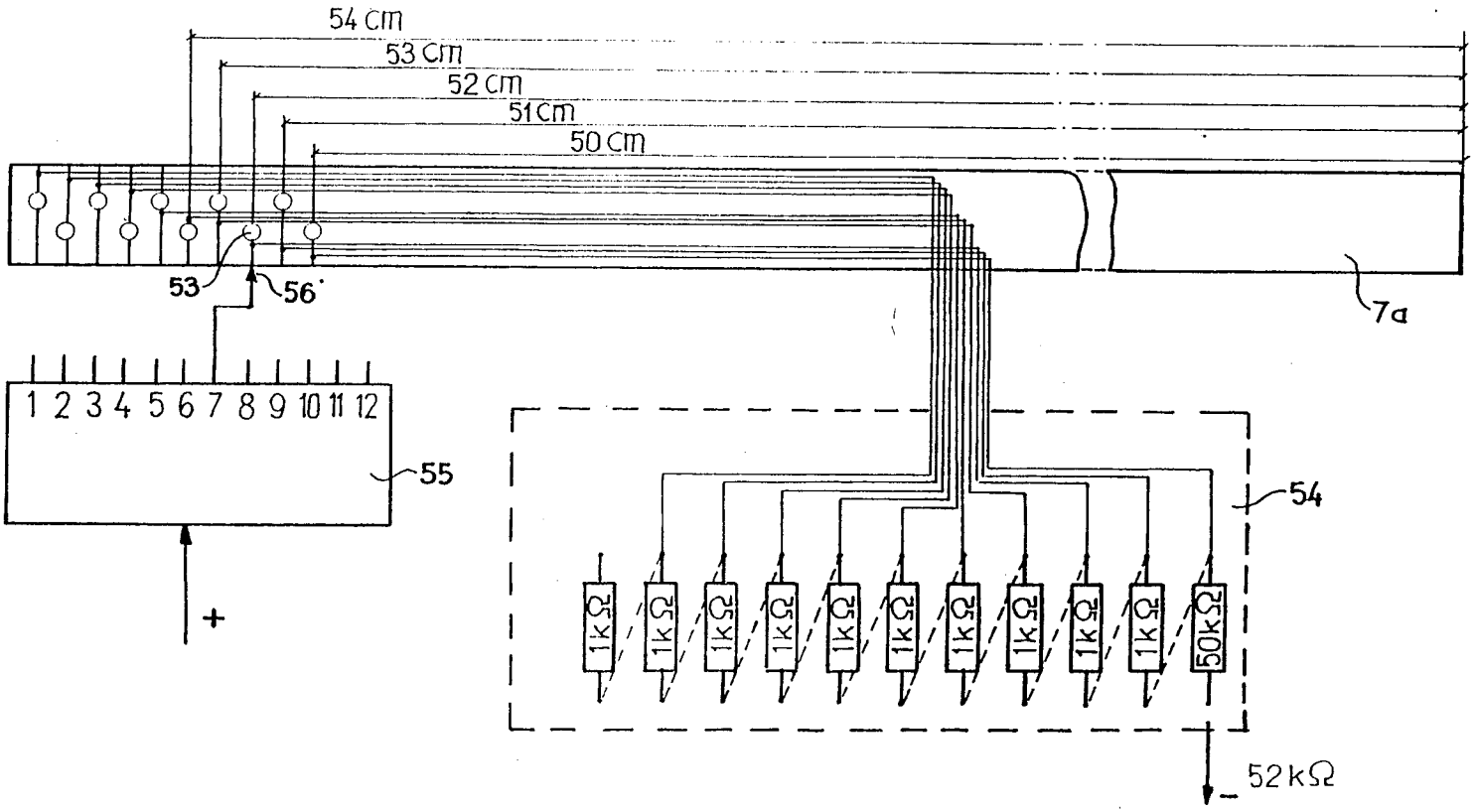

FIG. 9 shows an alternative embodiment of a measuring tape *7a*, the location of which on the measuring garment corresponds to the measuring tape 7 according to FIGS. 1A through 8A. This measuring tape consists of a electrically non-conductive material and the measuring ranges of the measuring tapes comprise a number of measuring points 53 which are electrically conductive and each of which is adapted for connection in a certain mutual order to an external measuring reference 54 which means that each measuring point on the tape corresponds to a certain measuring value in the reference. The measuring points 53 are moreover connected to a multiplexor 55 which is a connecting unit successively connecting an external current source to the different measuring tapes arranged on the measuring garment in order to measure the external resistance (or other electrical property) on the circuit card 54. From the multiplexor 55 cables lead to a contactor member 56 which is connected to the actual measuring point 53 wherefrom the electrical pulse is applied to the circuit card where the combined resistances of 52 kohm corresponding to the measuring point will be flown through by the current pulse. The value of the connected external resistors consequently corresponds to the measure 52 cm, which in turn corresponds to the position of the connected measuring point 53 on the measuring tape. Similarly, all measuring tapes 1–12 are successively connected via the multiplexor 55 operating in cyclical connecting sequences.

Figure 10:
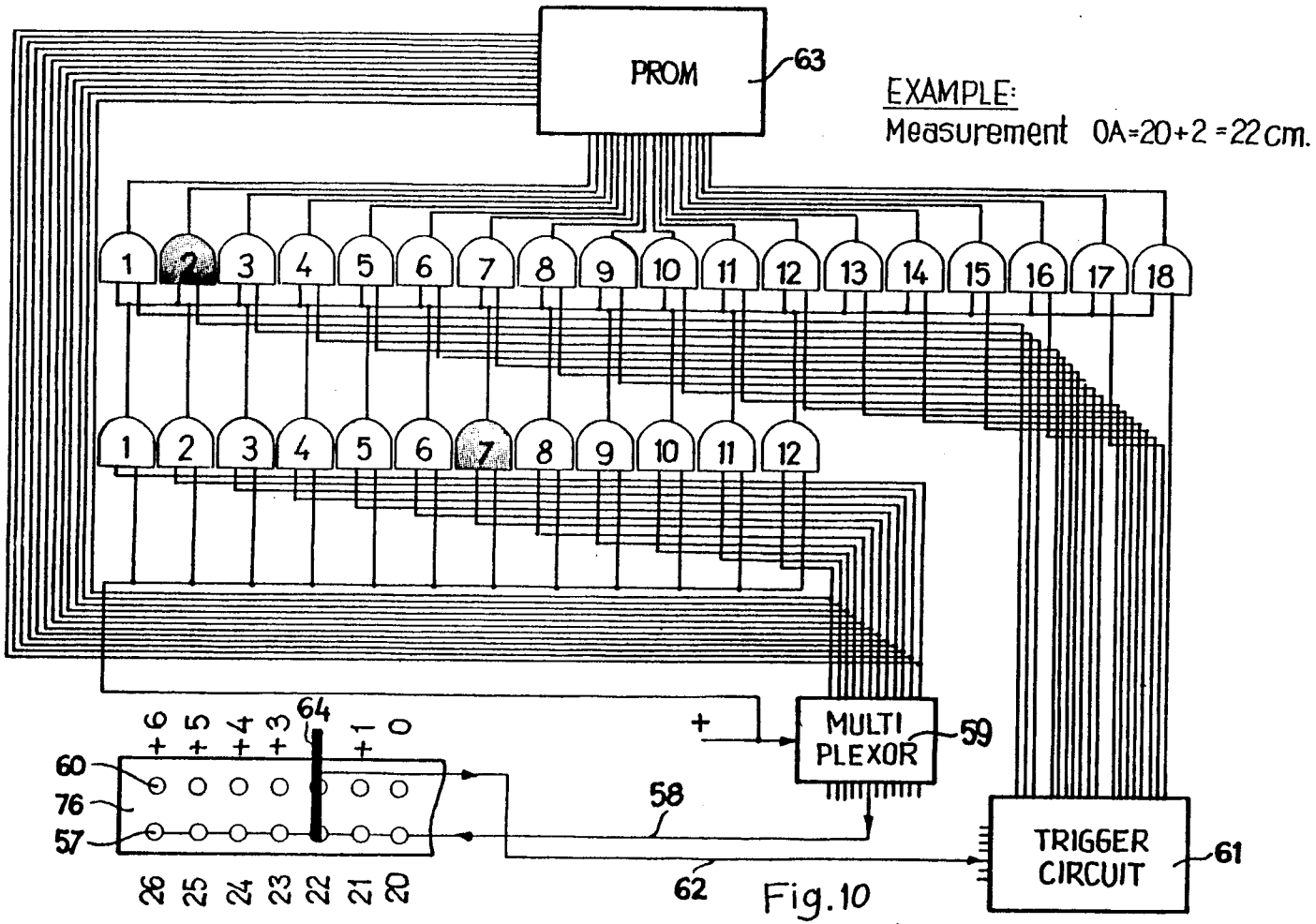

Another suitable embodiment of the measuring apparatus according to the invention is illustrated in FIG. 10 and is based on a digital method for the transfer of the measurement. The measuring tape *7b* consists of electrically non-conductive material, as was the case in the embodiment according to FIG. 9, the tape being provided with a number of electrically conductive measuring points of which the points in the lower row 57 are electrically connected to one another and to a supply line 58 which is connected to a multiplexor 59. The measuring points in the upper row 60 are isolated between themselves and each of them is connected to a trigger circuit 61. Taking measurements according to the digital method is thus accomplished such that the multiplexor 59 is rendered conductive whereby a voltage is applied on the right input of AND-gates 1–12. The multiplexor 59 detects successively and cyclically all connected measuring tapes and the corresponding AND-gates. In one case, illustrated on the Figure, the detection has reached the measuring tape *7b*, whereby the supply line 58 is conducting and the left input of the corresponding AND-gate is voltage-biased Simultaneously a signal is emitted from the multiplexor 59 to an address in a PROM-memory 63, said address corresponding to a basic measurement of the measuring tape *7b* just connected. When the AND-gate 7 opens a voltage will be applied on the left input of the succeeding AND-gate 1–8 corresponding to the measuring points 1–18 on the different measuring tapes. When current is applied on the supply line 58 a pulse is emitted from the measuring point 57 in the lower row of the measuring tape to a measuring point +2 in the upper row via a contact member 64 located on the measuring tape. Thus, the current pulse is applied via line 62 to the trigger circuit 61 which passes the pulse from the measuring point +2 to the corresponding right input on the AND-gate 2 which thereby opens and emits a pulse to an address in the PROM-memory 63 corresponding to the gate. The previously activated address for this measuring tape contains information about the basic measurement for the measuring point 0 on the measuring tape 7*b* which in this case is the value 20 cm. Since the address of the AND-gate 2 in the PROM-memory 63 corresponds to the value +2 cm these two values will be added and the searched measuring value will be obtained which according to the example shown on the Figure corresponds to the measurement 22 cm and relates to the distance OA which is the back vertical line on a level with the lower edge of the armhole.

Figures 11, 11A:
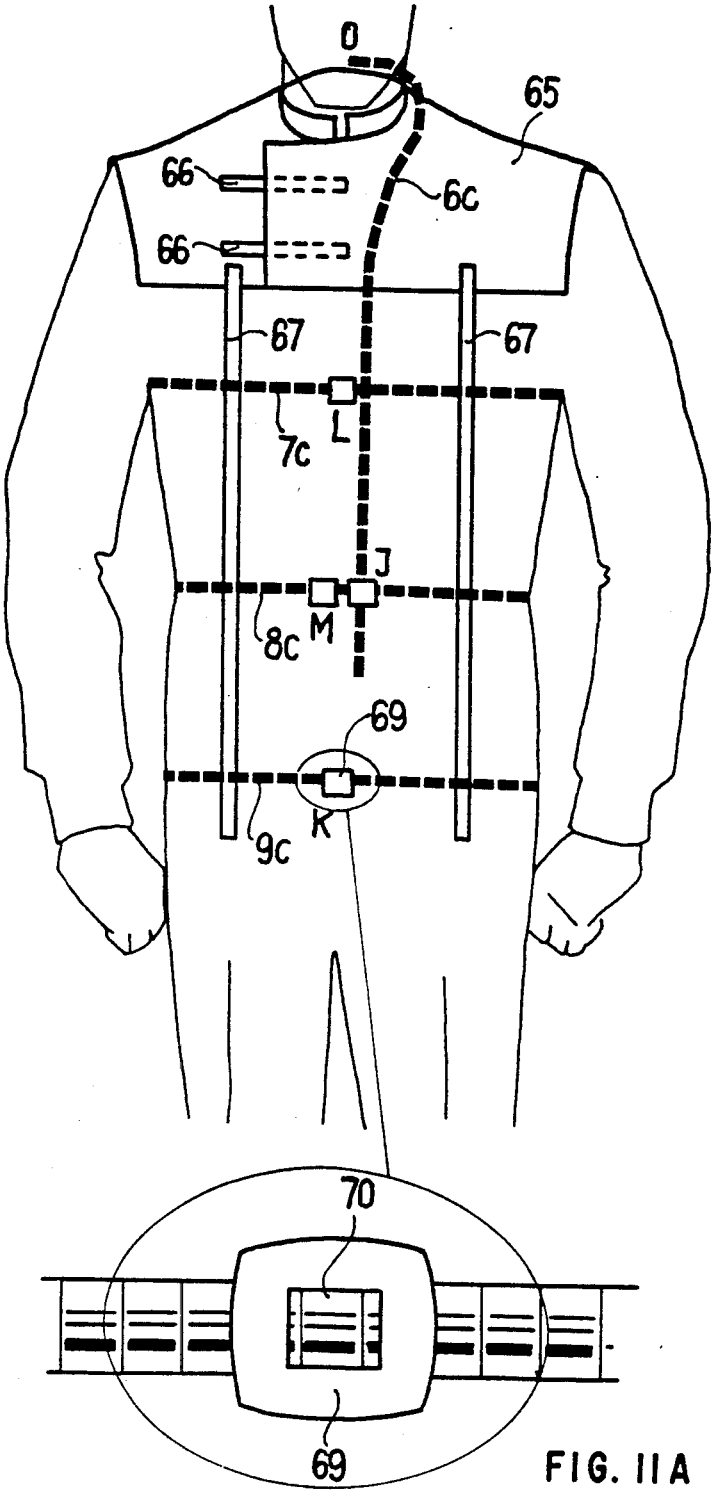
Figure 12:
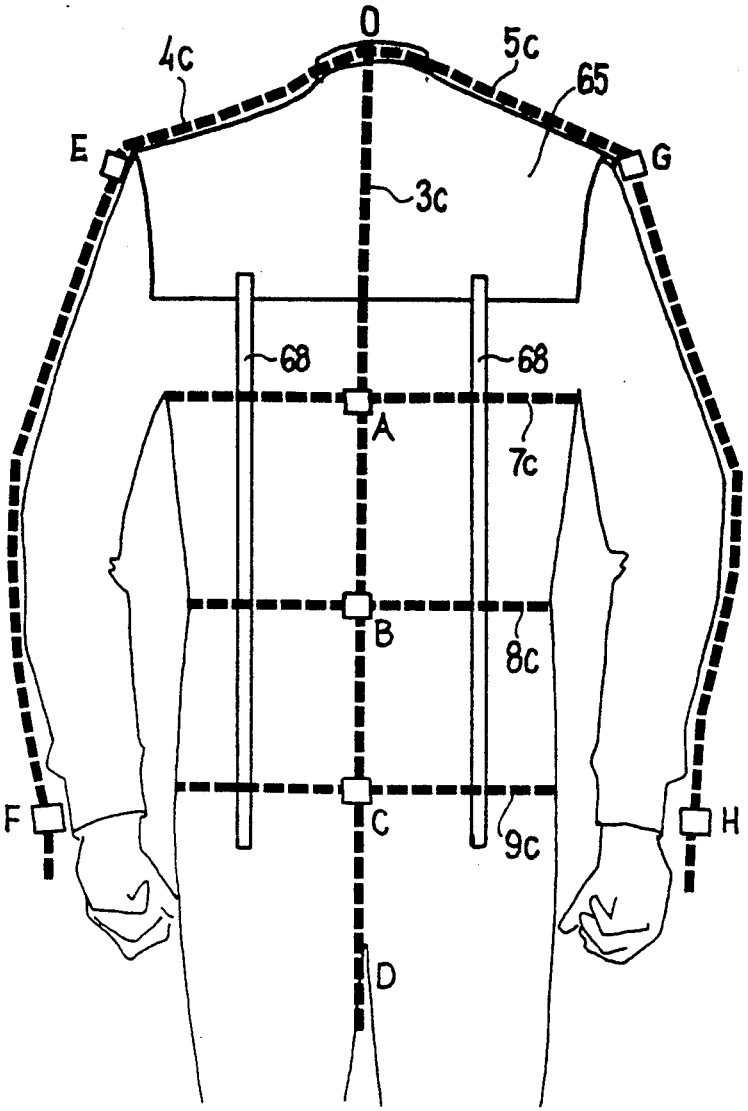

FIGS. 11 and 12 show a front view and a back view of an alternative embodiment of a measuring garment and designed as a shoulder yoke 65 which is adjustably buttoned up by means of VELCRO® tape or the like to make the yoke individually adaptable to the body measurements of a person. The yoke 65 is provided with four vertical VELCRO® tapes two at the front side 67 and two at the back side 68. The tapes are double and can consequently be torn apart in order to adjustably hold horizontal measuring tapes which are placed between the double VELCRO® tapes. The horizontal measuring tapes 7*c*, 8*c* and 9*c* are used, as previously, to measure the width round the chest, waist and seat. The front measuring tape 6*c* and the back measuring tape 3*c* are used for measuring those body measurements which are defined in the embodiment according to FIG. 1A. The same applies to the measuring tapes 4*c* and 5*c* going from the measuring point 0 from the atlas over the outer shoulder line extremities E and G and to the wrists F and H in the same way as described in connection with the embodiment according to FIG. 1A. The measuring tapes are provided with clasps 69 with an inner square 70 for the marking of the set measuring point. In this case the measuring tapes are graduated with an optical code, either a OCR-code or a stretch-code and the read-out is accomplished by means of a reading pen connected to a computer of conventional design. The measuring ranges of the measuring tape thus comprise several measuring points where the first measuring point has the code for the digit 0 with the remaining measuring points set in intervals of ½ or 1 cm depending on the demands on accuracy which are relevant for the measurement in question. The measuring area thus starts from the point of the measuring tape which corresponds to the value for the smallest size for the garment which is to be measured. Each measuring point can also comprise a letter in case it is an OCR grading to identify the different measurements. The read-out is consequently accomplished in the same way as has been described in connection with FIG. 10 where the basic measurements in question are stored in a PROM-memory.

The measuring tapes 7*c*, 8*c* and 9*c* which are intended for width measurement are inserted between the VELCRO® tapes on such a height that they will become substantially horizontal and coincide with the body lines of the measuring object. Then the sifting frames 69 which are made in the form of clasps are buttoned up so that the actual measurement can be read in the sift square 70. When taking vertical measurements the sift frames are displaced along the measuring tape until their position coincides with the position of the measuring points to be read. According to the invention all measuring tapes are placed on the person and are fastened in correct positions whereafter the read-out can be made in the shift frames. Since each measuring range on the measuring tapes also contains information about where and on which measuring tape the measuring range is located the measurements can be made in succession and the information thus obtained can form the base for a garment which has been individually adapted.

The measuring tapes just described can be made in many different applications falling within the scope of the invention such as magnetic tapes, punched tapes or in any other way which makes it possible to identify the different measuring points and guided thereby calculate the different measuring values.

The read-out can be accomplished in a corresponding way by utilizing means such as read-out heads or read-out forks.

Figure 13:
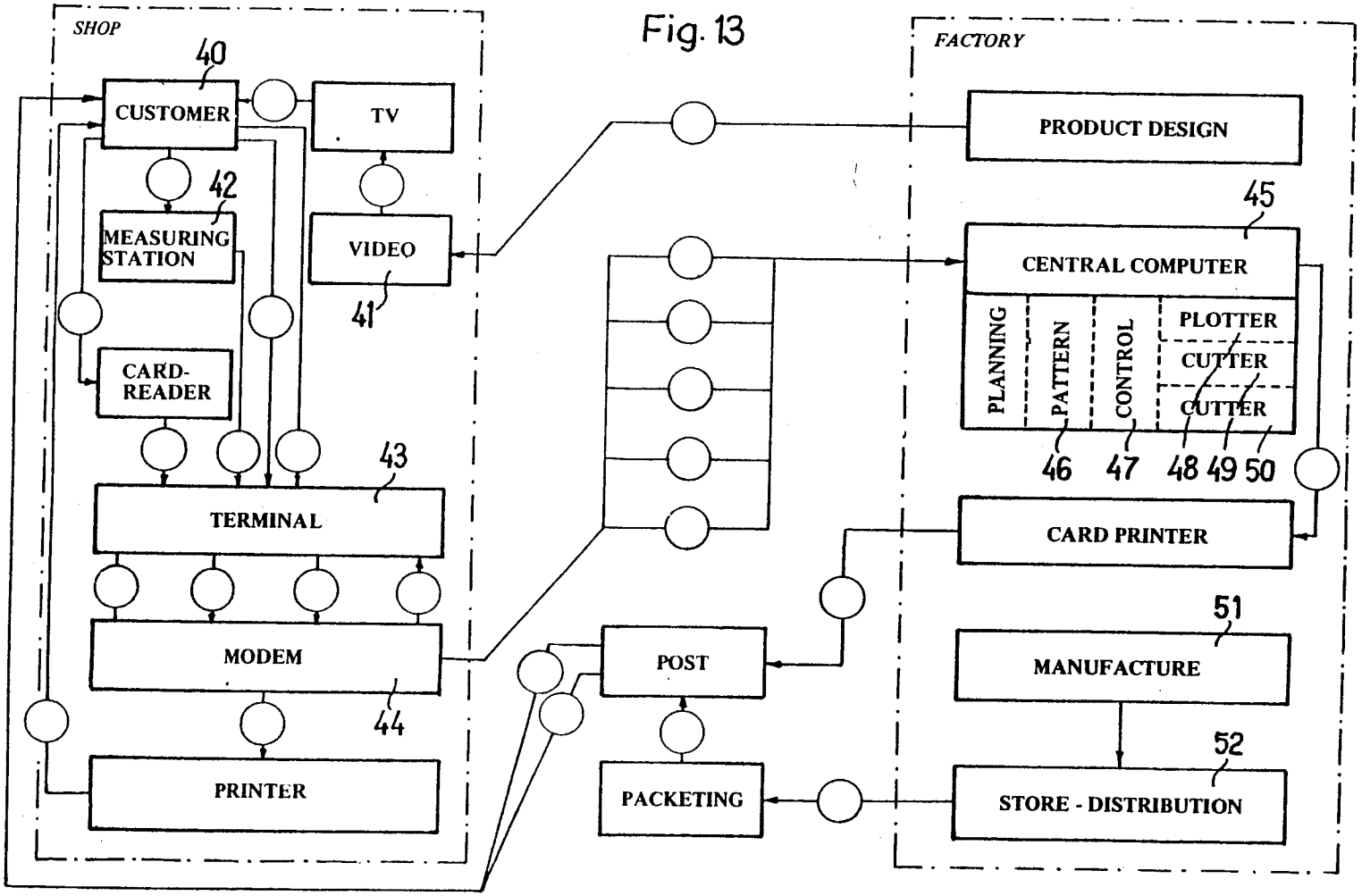

FIG. 13 illustrates in the form of a block diagram a conceivable implementation of a system for taking dimensions and producing garments in accordance with the invention. In principle, the diagram is divided into two main parts, namely a shop and a central factory, the two being united by a data communication network. The factory may of course be coupled to a plurality of shops. In an envisaged situation, a customer 40 thus comes into the shop, and there obtains information as to the range of garments in question, with the aid of a catalogue and/or models displayed in the shop. Supplementary information as to the entire range of products and all the conveivable possibilities available in it may be provided by means of the video-TV equipment 41. The customer is then taken to a measuring station 42, of the kind already described, and the analogue signals from it, representing his different, individual fitting measurements, are converted in a terminal 43 to digital information for sending, via modem 44, to a central computer 45 in the factory. Measurement and personal data are stored here in a central memory unit which also stores information on available standard sizes. The computer also includes a unit for comparing the individual measurements with standard sizes, the result of this comparison being transmitted to the shop for providing the customer with information about the different possibilities available for producing the desired apparel to a suitable price. Should the customer then place an order, his measurements (already received at the factory) are transferred to a pattern unit 46 in the main computer, from where information on the pattern for the ordered article is caused to actuate a control computer 47 for programming and controlling manufacturing machine units in the shape of a plotter 48 and cutters 49 and 50. After cutting, the garment is made up in a manufacturing department 51 in the factory, and goes from there to a distribution department 52, where the article is suitably vacuum-packed for postal distribution to the customer. In conjunction with the order, the customer can be given a personal measurements card or other record containing all the data measured in the shop, and which are necessary for producing the article. This information is thus stored on the card for use on a furture visit to the shop. All the customer now has to do is to choose the desired article, and then the data on this, together with the measurements recorded on the card may be transmitted to the factory computer for producing the desired article.

The system also affords advanced possibilities for the customer to choose from the entire range available at the factory, with regard to models, fabrics, colours and qualities. In spite of these selection facilities, the cost of the article itself will be substantially less than in conventional manufacture, because the costs of keeping stocks of finished garments at the factory, as well as at the shop are practically eliminated, which means that small premises will be satisfactory for the shop, with accompanying lower rent. As far as the factory is concerned, the system in accordance with the invention results in increased manufacture of garments with improved fitting, which, in conjunction with a reduced sale price gives better possibilities of competition and thereby an increased share of the market, giving clothing workers more secure employment and the possibility of better wage advancement.

I claim:

1. A method for measuring a body, comprising the steps of:

providing a measuring garment having at least one adjustably attachable measuring tape including electrically detectable means capable of generating an electrical signal in accordance with a position of adjustment of said tape;

adjusting said measuring tape to fit the body part being measured so that said electrically detectable means generates an electrical signal; and conducting said electrical signal to a central memory and calculating unit for transforming said signal into a pattern dimension.

2. The method for measuring a body of claim 1, wherein there are a plurality of said tapes, each for measuring a different body part and including said electrically detectable means for producing an electrical signal, and including the step of conducting each of said signals to said central memory and calculating unit for transforming said signals into separate pattern dimensions.

3. A method for measuring a body, comprising the steps of:

providing a measuring garment having at least one adjustably attachable measuring tape including optically readable means capable of indicating a position of adjustment of said tape and capable of being read by an optical scanner;

adjusting said measuring tape to fit the body part being measured so that said optically readable means provides a readable indication thereof;

retaining said tape in its adjusted position by fastening means;

detecting said optically readable means by said optical scanner and generating an electrical signal therefrom; and conducting said electrical signal to a central memory and calculating unit for transforming said signal into a pattern dimension.

4. The method for measuring a body of claim 3, wherein there are a plurality of said tapes, each for measuring a different body part and including said optically readable means, and including the steps of detecting each of said optically readable means by said optical scanner and generating electrical signals therefrom, and conducting each of said signals to said central memory and calculating unit for transforming said signals into separate pattern dimensions.

5. An apparatus for measuring a body comprising:

a measuring garment having at least one adjustably attached measuring tape for measuring a body part, said tape including electrically detectable means capable of generating an electrical signal in accordance with a position of adjustment of said tape;

fastener means for holding said tape in said position of adjustment when said tape is adjusted to fit the body part being measured;

connecting means for connecting with said tape and transforming said position of adjustment into said electrical signal;

a central memory and calculating unit for transforming said electrical signal into a pattern dimension; and means for conducting said electrical signal from said tape to said central memory and calculating unit.

6. The apparatus for measuring a body of claim 5, wherein said at least one measuring tape is electrically conductive and includes a material the properties of which are proportional to a unit length of the material.

7. The apparatus for measuring a body of claim 5, wherein said electrical signal is an indication of resistance of the tape.

8. The apparatus for measuring a body of claim 5, wherein said electrical signal is an indication of capacitance of the tape.

9. The apparatus for measuring a body of claim 5, wherein said electrical signal is an indication of inductance of the tape.

10. The apparatus for measuring a body of claim 5, wherein said tape is variably semi-conductive.

11. An apparatus for measuring a body comprising:

a measuring garment having at least one adjustably attached measuring tape for measuring a body part, said tape including optically readable means capable of indicating the position of adjustment of said tape and being read by an optical scanner;

fastener means for holding said tape in a position of adjustment when said tape is adjusted to fit a body part being measured;

an optical scanner for detecting said optically readable means and generating an electrical signal therefrom; and a central memory and calculating unit operably connected to said scanner for transforming said electrical signal into a pattern dimension.

12. An apparatus for measuring a body comprising:

a measuring garment having at least one adjustably attached, electrically conductive measuring tape for measuring a body part, said tape being positionable to fit the body part being measured so that an effective length and an electrical characteristic of the electrically conductive tape is provided, which electrical characteristic is a function of a dimension of the body part being measured;

fastener means for holding said tape in a position of adjustment;

means for conducting current through said adjusted tape to produce an electrical signal in accordance with the electrical characteristic of said adjusted tape;

measuring means operatively connected to said tape for measuring said electrical signal; and means operatively connected to said measuring means for transforming said electrical signal into a pattern dimension.

13. The apparatus for measuring a body of claim 12, wherein said electrical characteristic is an indication of the resistance of the tape.

14. The apparatus for measuring a body of claim 12, wherein said electrical characteristic is an indication of the capacitance of the tape.

15. The apparatus for measuring a body of claim 12, wherein said electrical characteristic is an indication of the inductance of the tape.

16. The apparatus for measuring a body of claim 12, wherein said measuring tape is variably semi-conductive.

* * * * *